US005993175A

United States Patent [19]

Kim et al.

[11] Patent Number: 5,993,175

[45] Date of Patent: Nov. 30, 1999

[54] OIL SUPPLY APPARATUS FOR FRICTION PORTION OF LINEAR COMPRESSOR

[75] Inventors: Hyung Jin Kim, Seoul; Hyung Kook Lee, Kyungki-do, both of Rep. of Korea

[73] Assignee: LG Electronics Inc., Rep. of Korea

[21] Appl. No.: 08/793,553

[22] PCT Filed: Jun. 24, 1996

[86] PCT No.: PCT/KR96/00095

§ 371 Date: Feb. 21, 1997

§ 102(e) Date: Feb. 21, 1997

[87] PCT Pub. No.: WO97/01032

PCT Pub. Date: Jan. 9, 1997

[30] Foreign Application Priority Data

Jun. 23, 1995 [KR] Rep. of Korea ..... 95-17073
Aug. 16, 1995 [KR] Rep. of Korea ..... 95-21029 U

[51] Int. Cl.[6] ..... F04B 17/04

[52] U.S. Cl. ..... 417/417; 417/571; 184/6.8; 184/6.17

[58] Field of Search ..... 417/417, 571, 417/312, 366, 560, 569; 184/6.8, 6.17, 100; 137/512, 855, 15

[56] References Cited

U.S. PATENT DOCUMENTS 3,325,085 6/1967 Gaus .
3,538,357 11/1970 Barthalon .
3,814,550 6/1974 Adams ..... 417/417
4,032,264 6/1977 Takahashi .
5,110,272 5/1992 Peruzzi et al. ..... 417/571
5,577,901 11/1996 Yoon ..... 417/571

*Primary Examiner*—Thomas E. Denion
*Assistant Examiner*—Apollo Nguyen
*Attorney, Agent, or Firm*—Ostrolenk, Faber, Gerb & Soffen, LLP

[57] ABSTRACT

An improved oil supply apparatus for a friction portion of a linear compressor which is capable of enhancing the lubricating performance of the piston by substantially supplying oil to the fricton portion between a cylinder (122') and a piston (129), thus enabling a desired reciprocating movement of the piston (129), which includes a cylinder (122') having a plurality of oil introducing holes (122*a*) for communicating the inside and the outside of the cylinder (122'); an oil mass (131) disposed between the cylinder and a core liner spaced apart from the cylinder (122') and slidable whithin an oil pocket (132) communicating with the cylinder (122') by an oil suction hole (143*c*); an elastic member (133, 134) for elastically supporting the oil mass (131); and a valve assembly (139') for a refrigerant gas flowing path for guiding the flowing of the refrigerant gas, a suction gasket (141) integral with an oil flowing path for guiding the flowing of the oil supplied to and discharged from the friction portion between the cylinder (122') and the piston (129), a suction valve (142), a valve sheet (143), a discharging valve (144), a discharging gasket (145), and a head cover (146).

21 Claims, 7 Drawing Sheets

OIL SUPPLY APPARATUS FOR FRICTION PORTION OF LINEAR COMPRESSOR

TECHNICAL FIELD

The present invention relates to an oil supply apparatus for a friction portion of a linear compressor, and particularly to an improved oil supply apparatus for a friction portion of a linear compressor which is capable of enhancing a lubricating efficiency between a cylinder and a piston by substantially providing oil to a friction portion therebetween and enabling a more smooth piston reciprocating movement within the cylinder, so that the interior of the cylinder heated by a refrigerant gas having a high temperature and pressure is efficiently cooled, and a manufacturing cost is reduced, and the productivity can be improved thereby.

BACKGROUND ART

Generally, a refrigerator works for 24 hours per day. The refrigerator accounts for one-third the total consumption of the electrical energy of the home appliance. The compressor uses about 80–90% of the power consumption of the refrigerator.

Therefore, much study with respect to the compressor has been conducted so as to enhance the efficiency thereof and reduce the power consumption.

However, so far since the compressor is fabricated in a method of using the crank shaft for converting the rotation movement of the motor into a linear reciprocating movement of the piston, the parts related to the crank shaft such as a connecting rod, a bearing, and the like are additionally necessary, so the number of elements are increased, and thus the fabricating cost is increased, thus degrading the productivity.

In addition, when the compressor is in operation, many friction occur between elements, so the efficiency of the compressor is degraded, and power consumption is increased.

Therefore, so as to resolve the above-mentioned problems, a linear compressor was introduced in the industry, which is directed to reciprocating the piston using a magnet and a coil without using the crank shaft.

Namely, the linear compressor is directed to reducing the fabricating cost and improving the productivity. In more detail, it is possible to increase the efficiency by more than 90% by reducing the friction portions between elements by reducing the number of elements, thus reducing the power consumption.

The linear compressor is directed to basically improving the efficiency by smoothly enabling the reciprocating movement of the piston.

In the industry, various types of the oil supply apparatus for a friction portion of the compressor was introduced, which was directed to smoothly enabling the reciprocating movement of the piston by supplying oil to the friction portion between the cylinder and the piston. Of which, for example, one conventional linear compressor equipped with the oil supply apparatus for a friction portion will now be described.

FIG. 1 shows the conventional linear compressor equipped with the oil supply apparatus for a friction portion. As shown therein, a cylinder 2 is disposed within a predetermined shaped hermetic housing 1.

Coil assemblies 3 and 3*a* are integrally engaged to the cylinder 2.

A piston spring 4 is provided at one side of the cylinder 2, and a piston 5 is connected to the intermediate portion of the piston spring 4 in order for the same to reciprocate within the cylinder 2.

A magnet 6 is disposed at the outer circumferential surface of the piston 5, and a plurality of mounting springs 7 for elastically supporting the piston spring 4 are elastically connected between the piston spring 4 and the hermetic housing 1.

Meanwhile, a valve assembly 8 is disposed at one side of the cylinder 2, and a suction-side muffler 9 and a discharging-side muffler 9*a* are mounted at both sides of the valve assembly 8.

An oil suction tube 10 is downwardly connected to a predetermined portion of the suction-side muffler 9 so as to suck the oil "O" filled in the bottom portion of the hermetic housing 1.

As shown in FIG. 2, the valve assembly 8 includes a suction gasket 11, a discharging gasket 15, a suction valve 12, a discharging valve 14, and a valve sheet 13. Here, the above-mentioned elements are tightly engaged to one another, and will be described in more detail.

First, a hole 11*a* is formed at the center portion of the suction gasket 11, and a predetermined shaped suction opening/closing portion 12*a* is movably attached at the center portion of the suction valve 12, and a discharging hole 12*b* is formed at one side of the suction opening/closing unit 12*a*.

In addition, a suction hole 13*a* is formed at the center portion of the valve sheet 13, and a discharging hole 13*b* is formed at one side of the suction hole 13*a*.

Meanwhile, a discharging opening/closing portion 14*b* is formed at a predetermined portion of the discharging valve 14 so as to open/close the discharging hole 13*b* of the valve sheet 13, and a suction hole 14*a* is formed at the center portion of the discharging valve 14.

In addition, a suction hole 15*a* is formed at the center portion of the discharging gasket 15.

In the drawings, reference numeral 16 denotes a head cover.

The operation of the conventional linear compressor will now be explained.

The conventional linear compressor includes the magnet 6 fixed to the coil assemblies 3 and 3*a* and the piston 5 which are fixed to the cylinder 2 for the major function of the linear motor.

In addition, so as to enhance the efficiency of the linear compressor, the piston 8 should most efficiently reciprocate in the system.

Therefore, when the piston 5 is moved in a predetermined direction indicated by the arrow "A" of FIG. 1 in the interior of the cylinder by an inertia energy and elastic energy which are generated by the coil assemblies 3 and 3*a* and the magnet 6, the pressure in a compressing space "C" is lowered, so that the refrigerant gas is introduced into the compressing space "C" of the cylinder 2 through the suction holes 15*a* and 14*a* of the discharging gasket 15 and the discharging valve 14.

Therefore, when the discharging opening/closing portion 14*b* of the discharging valve 14 closes the discharging hole 13*b* of the valve sheet 13, the refrigerant gas is introduced into the suction hole 13*a* of the valve sheet 13, so that the refrigerant gas pushes the suction opening/closing portion 12*a* in the right-side direction of FIG. 2, and then the refrigerant gas is introduced into the compressing space "C" of the cylinder 2 through the hole 11*a* of the suction gasket 11.

At this time, since the oil "O" filled at the bottom portion of the hermetic housing 1 is connected to the suction-side muffler, the oil "O" is sucked up along the oil suction tube 10 and then is introduced into the compressing space "C" together with the refrigerant gas along the flowing path of the refrigerant gas, and is supplied to the friction portion between the cylinder 2 and the piston 5.

Meanwhile, on the contrary, when the piston 5 is moved in the direction indicated by the arrow "B" of FIG. 1, the refrigerant gas is compressed in the compressing space "C", and the refrigerant gas pushes the suction opening/closing portion 12*a* of the suction valve 12 in the leftside direction of FIG. 2, and thus the suction hole 13*a* of the valve sheet 13 is closed.

Therefore, the refrigerant gas pushes the discharging opening/closing portion 14*b* of the discharging valve 14 through the discharging holes 12*b* and 13*b* of the suction valve 12 and the valve sheet 13, and then passes through the discharging gasket 15, and is discharged to the outside of the hermetic housing 1 through the head cover 16 and the discharging-side muffler 9*a*.

When the piston 5 continuously reciprocates within the cylinder 2, and the suction, compression, and discharging of the refrigerant gas is repeatedly performed, the oil "O" serves to enable a smooth reciprocating operation of the piston 5 in cooperation with the oil "O" provided at the friction portion between the cylinder 2 and the piston 5.

In more detail, when the piston 5 is moved in the direction indicated by the arrow "A" of FIG. 1, since the pressure in the compression space "C" is made lower, the oil "O" in the bottom portion of the hermetic housing 1 is sucked up along the oil suction tube 10 and then is introduced into the compression space "C" together with the suction refrigerant gas, and is supplied to the friction portion between the cylinder 2 and the piston 5.

However, since the conventional linear compressor has a disadvantage in that the oil "O" in the bottom portion of the hermetic housing 1 is supplied to the above-mentioned friction portion together with the suction refrigerant gas through the suction-side muffler 9. In addition, since the oil "O" introduced into the compression space "C" together with the suction refrigerant gas is not substantially provided to the cylinder 2 and the piston 5 and then is directly discharged through the discharging-side muffler 9*a* in cooperation with the compression operation of the piston, the oil "O" is not substantially supplied to the friction portion between the cylinder 2 and the piston 5.

In addition, since the conventional linear compressor has a disadvantage in that the oil is not substantially supplied to the friction portion between the cylinder and the piston, and a lot of the oil is directly discharged together with the compression refrigerant gas, whereby the cylinder heated due to the compression gas of the high temperature is not effectively cooled, thus reducing the efficiency of the compressor.

DISCLOSURE OF THE INVENTION

Accordingly, it is an object of the present invention to provide an oil supply apparatus for a friction portion of a linear compressor, which overcome the problems encountered in a conventional oil supply apparatus for a friction portion of a linear compressor.

It is another object of the present invention to provide an improved oil supply apparatus for a friction portion of a linear compressor which is capable of enhancing the lubricating performance of the piston by substantially supplying oil to the friction portion between a cylinder and a piston, thus enabling a desired reciprocating movement of the piston.

It is another object of the present invention to provide an improved oil supply apparatus for a friction portion of a linear compressor which is capable of enhancing the cooling efficiency of the cylinder and the piston by increasing the suction amount and discharging amount of the oil.

It is another object of the present invention to provide an improved oil supply apparatus for a friction portion of a linear compressor which is capable of reducing the manufacturing cost and improving the productivity by simplifying the flowing path of the refrigerant gas and the flowing path of the oil to be made into one structure.

It is another object of the present invention to provide an improved oil supply apparatus for a friction portion of a linear compressor which is capable of reducing the noise of the system by effectively absorbing the vibration of the system.

To achieve the above objects, in accordance with a first embodiment of the present invention, there is provided an oil supply apparatus for a friction portion of a linear compressor, which includes a cylinder having a plurality of oil introducing holes for communicating the inside and the outside of the cylinder; an oil displacing mass disposed between the cylinder and a core liner spaced apart from the cylinder and slidable within an oil pocket communicating with the cylinder by an oil suction hole; an elastic member for elastically supporting the oil mass; and a valve assembly for a refrigerant gas flowing path for guiding the flowing of the refrigerant gas, a suction gasket integral with an oil flowing path for guiding the flowing of the oil supplied to and discharged from the friction portion between the cylinder and the piston, a suction valve, a valve sheet, a discharging valve, a discharging gasket, and a head cover.

To achieve the above objects, in accordance with a second embodiment of the present invention, there is provided an oil supply apparatus for a friction portion of a linear compressor, which includes a cylinder having a plurality of oil introducing holes for communicating the inside and the outside of the cylinder; an oil mass disposed between the cylinder and a core liner spaced apart from the cylinder and slidable within an oil pocket communicating with the cylinder by an oil suction hole; an elastic member for elastically supporting the oil displacing mass; and an oil suction tube communicating with the oil pocket so as to suck the oil filled at the bottom portion of the hermetic housing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

MODES FOR CARRYING OUT THE INVENTION

Figure 3:
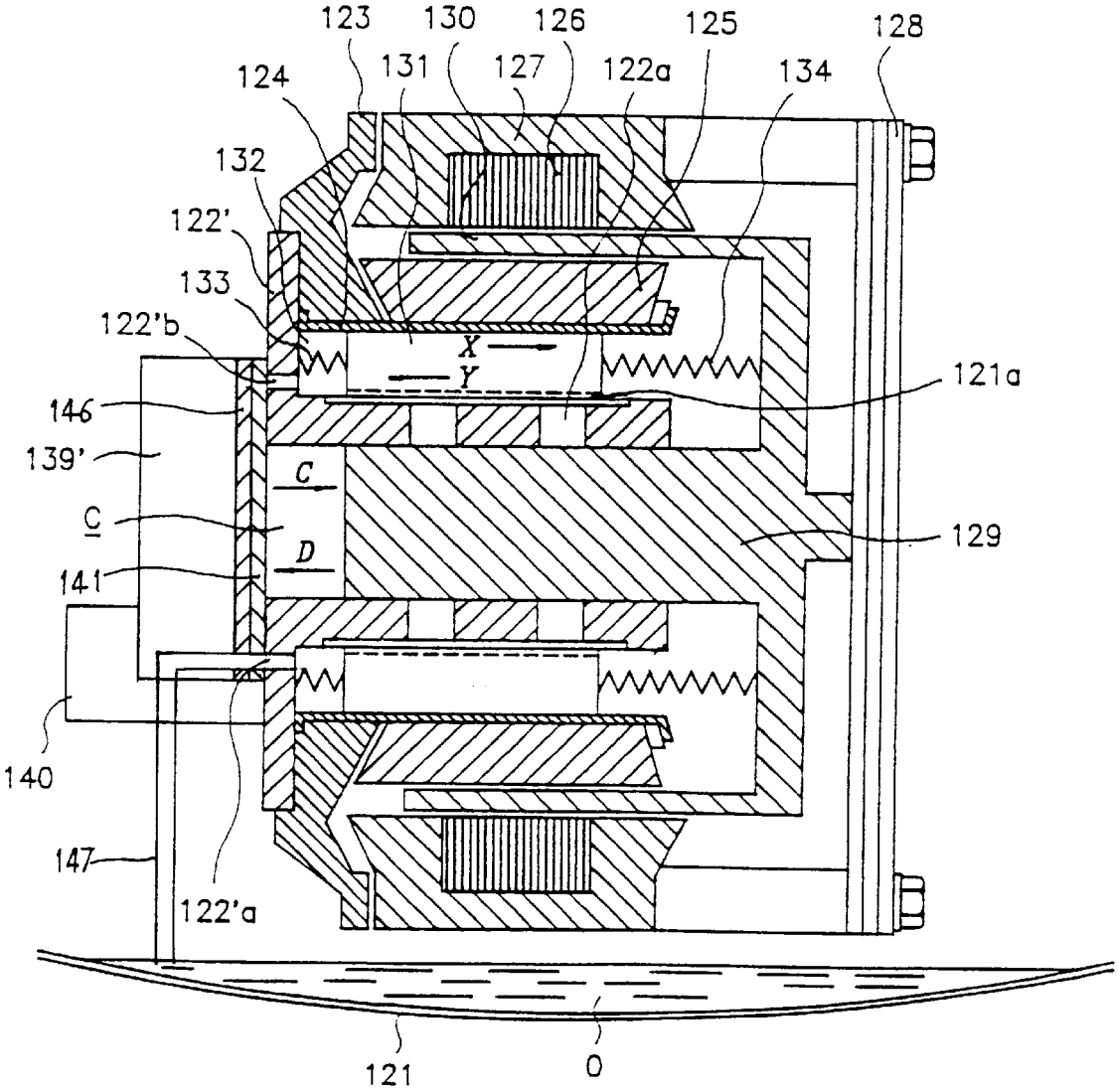
FIG. 3 is a cross-sectional view of an oil supply apparatus for a friction portion of a linear compressor according to a first embodiment of the present invention.

FIG. 3 shows an oil supply apparatus for a friction portion of a linear compressor according to a first embodiment of the present invention, which includes a cylinder 122' having a plurality of oil introducing holes 122'*a* formed at a flange portion of the cylinder 122' for communicating with the inner side and the outer side of the cylinder 122' and disposed in a predetermined shaped hermetic housing 121.

In addition, a flange 123 is attached to the cylinder 122', and a core liner 124 is attached to the inner wall of the flange 123, and an inner lamination 125 is attached to the outer circumferential surface of the core liner 124.

Here, the inner lamination 125 serves to reduce the loss of magnetic field, and to reduce the noise due to the refrigerant gas.

A stator 127 having a stator coil 126 is disposed at the periphery of the flange 123 and is spaced apart from the core liner 124 by a predetermined distance.

A piston spring 128 is disposed behind the cylinder 122', and a piston 129 is disposed within the cylinder 122' and reciprocates therewithin.

A magnet 130 is spaced apart from the outer circumferential surface the piston 129, and reciprocates between the inner lamination 125 and the stator 127 in cooperation with the movement of the piston 129, and an oil mass 131 is slidably provided between the cylinder 122' and the core liner 124 supporting the inner lamination 125.

Therefore, an oil pocket 132 is defined by the cylinder 122', the core liner 124, and the movement of the oil displacing mass 131.

Here, the position of the oil introducing hole 122*a* of the cylinder 202' may be positioned at a predetermined portion where the oil "O" can be substantially supplied to the friction portion between the cylinder 122' and the piston 129.

In addition, the oil displacing mass 131, the cylinder 122', and the core liner 124 are preferably cylindrically shaped. Here, the shape of the same is not limited thereto, any shape which can most effectively implementing the objects of the present invention can be possible.

Meanwhile, an oil path 121*a* is formed at a predetermined portion of the oil displacing mass 131 in order for the oil "O" introduced into the oil pocket 132 to be effectively introduced into the cylinder 122' by a predetermined movement of the oil mass 131.

Here, the oil path 121*a* may be formed at the outer circumferential surface of the cylinder 122'.

Therefore, the oil "O" introduced into the oil pocket 132 can be effectively introduced into the cylinder 122' through the oil path 121*a* of the oil mass 131 and the oil path 122*a* of the cylinder 122'.

Meanwhile, the oil displacing mass 131 is elastically supported by the inner wall of the piston 129.

The elastic means is referred to an elastic member 133 disposed between the cylinder 122' and the oil displacing mass 131, or elastic members 133 and 134 disposed between the cylinder 122' and the oil displacing mass 131, and the oil displacing mass 131 and the piston 129.

Here, as the elastic member 133 and 134, a plate spring, a conic-shaped spring, and the like may be used. Any shape of the same is not limited thereto.

In addition, as in the first embodiment of the present invention of FIG. 3, when disposing the elastic members 133 and 134 at both sides of the oil displacing mass 131, a flexible rod may be used between the oil displacing mass 131 and the piston 129 instead of the spring.

Meanwhile, a valve assembly 139' and a muffler 140 are disposed at one side of the cylinder 122'.

The oil supply apparatus for a friction portion of a linear compressor according to the first embodiment of the present invention is directed to integrally forming the refrigerant gas path for guiding the flow of the refrigerant gas to the valve assembly 139' and the oil path for guiding the flow of the oil which is supplied to the friction portion between the cylinder 122' and the piston 129.

The elements of the valve assembly 139' will now be explained in more detail.

Figure 4:
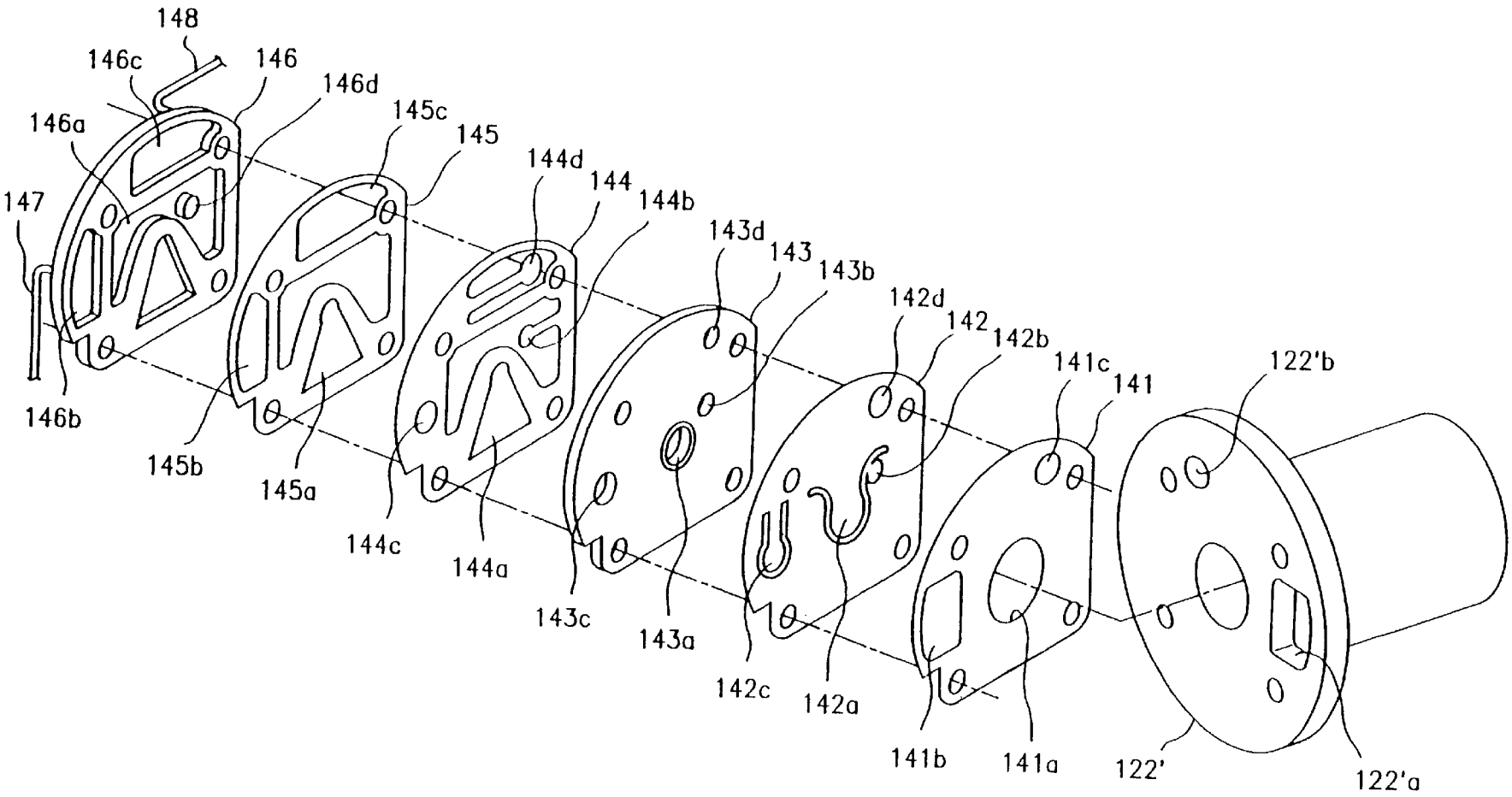
FIG. 4 is a disassembled perspective view of a valve assembly of a linear compressor according to a first embodiment of the present invention.

As shown in FIG. 4, the valve assembly 139' includes a suction gasket 141, a suction valve 142, a valve sheet 143, a discharging valve 144, a discharging gasket 145, and a head cover 146. The above-mentioned elements are tightly attached to one another by a plurality of bolts.

A hole 141*a* is formed at the center portion of the suction gasket 141 and communicates with the interior of the cylinder 122', and an oil suction hole 141*b* and an oil discharging hole 141*c* are spaced apart from each other and formed at predetermined portions of the same for guiding the flow of the oil "O".

In addition, an elastic refrigerant gas suction opening/closing portion 142*a* is formed at the center portion of the suction valve 142 and is opened/closed by the refrigerant gas. A refrigerant gas discharging hole 142*b* is formed at a predetermined portion of the refrigerant gas suction opening/closing portion 142*a* for guiding the discharging of the refrigerant gas, and an oil suction hole 142*c* is formed at a predetermined portion of the suction valve 142, and an oil discharging hole 142*d* is formed at a predetermined portion of the suction valve 142 in order for the oil to be discharged therethrough.

In addition, the valve sheet 143 includes a refrigerant gas suction hole 143*a* formed at the center portion of the same in order for the refrigerant gas to be sucked therethrough, a refrigerant gas discharging hole 143*b* formed at one side of the refrigerant gas suction hole 143*a* in order for the refrigerant gas to be discharged therethrough, an oil suction hole 143*c* formed at a predetermined portion of the same in order for the oil to be sucked therethrough, and an oil discharging hole 143*d* formed at a predetermined portion of the same in order for the oil to be discharged therethrough.

The discharging valve 144 includes a refrigerant gas suction hole 144*a* formed at the center portion and the lower portion of the same for sucking the refrigerant gas therethrough, an elastic refrigerant gas discharging opening/closing portion 144*b* formed at a predetermined portion of the same which is operated when the refrigerant gas is discharged, an oil suction hole 144*c* formed in order for the oil to be sucked therethrough, and an oil discharging opening/closing portion 144*d* which is operated when the oil is discharged.

The discharging gasket 145 includes a refrigerant gas suction hole 145*a* formed at the center and lower portion of the same for sucking the refrigerant gas therethrough, an oil suction hole 145*b* formed at a predetermined portion of the same for guiding the flow of the oil "O", and an oil discharging hole 145*c* formed at a predetermined portion of the same for discharging the oil therethrough.

The head cover 146 includes a refrigerant gas discharging portion 146*a* formed at the center portion of the same, an oil suction portion 146*b* and an oil discharging portion 146*c* formed at predetermined portions of the same for sucking and discharging the oil therethrough. An oil suction tube 147 and an oil discharging tube 148 are connected to the oil suction portion 146*b* and the oil discharging portion 146*c*, respectively.

In addition, a refrigerant discharging tube (not shown) is connected to the refrigerant discharging portion 146*a*. In the drawings, reference numeral 146*d* denotes a stopper.

Meanwhile, an oil passing-through holes 122'*a* and 122'*b* is formed at both sides of the flange portion of the cylinder 122' in order for the oil suction hole 141*b* and the oil discharging hole 141*c* of the suction gasket 141 to communicate with the oil pocket 132.

The valve assembly 139' used in the oil supply apparatus for a friction portion of a linear compressor according to the first embodiment of the present invention is directed to basically forming the refrigerant gas flowing path communicating the refrigerant suction hole 145*a* of the discharging gasket 145, the refrigerant suction hole 144*a* of the discharging valve 144, the refrigerant suction hole 143*a* of the valve sheet 143, the refrigerant gas suction opening/closing portion 142*a* of the suction valve 142, the hole 141*a* of the suction gasket 141, the refrigerant gas discharging hole 142*b* of the suction valve 142, the refrigerant gas discharging hole 143*b* of the valve sheet 143, the refrigerant gas discharging opening/closing portion 144*b* of the discharging valve 144, and the refrigerant gas discharging portion 146*a* of the head cover 146.

In addition, the valve assembly 139' used in the oil supply apparatus for a friction portion of a linear compressor according to the first embodiment of the present invention is directed to basically forming the oil flowing path communicating the oil suction portion 146*b* of the head cover 146, the oil suction hole 145*b* of the discharging gasket 145, the oil suction hole 144*c* of the discharging valve 144, the oil suction hole 143*c* of the valve sheet 143, the oil suction opening/closing portion 142*c* of the suction valve 142, the oil suction hole 141*b* and the oil discharging hole 141*c* of the suction gasket 141, the oil discharging hole 142*d* of the suction valve 142, the oil discharging hole 143*d* of the valve sheet 143, the oil discharging opening/closing portion 144*d* of the discharging valve 144, the oil discharging hole 145*c* of the discharging gasket 145, and the oil discharging portion 146*c* of the head cover 146.

The operation and effects of the oil supply apparatus for a friction portion of a linear compressor according to the first embodiment of the present invention will now be explained with reference to the accompanying drawings.

As shown in FIG. 3, the piston 129 reciprocates within the cylinder in cooperation with a predetermined interrelationship between the current flowing at the stator coil 126 and the magnet 130 attached to the piston 129 and the inertia energy and elastic energy of the piston spring 128.

In more detail, when the piston 129 moves in the direction indicated by the arrow "C" of FIG. 3 so as to suck the refrigerant gas, the refrigerant gas is introduced through the the refrigerant gas suction holes 145*a* and 144*a* of the discharging gasket 145 and the discharging valve 144, and the refrigerant gas discharging hole 143*b* of the valve sheet 143 is closed by the refrigerant gas discharging opening/closing portion 144*b* of the discharging valve 144.

At the same time, the refrigerant gas is introduced through the refrigerant gas suction hole 143*a* of the valve sheet 143, and pushes the refrigerant gas suction opening/closing portion 142*a* of the suction valve 142 in the right-side direction of FIG. 4 in order for the refrigerant gas to be introduced into the compressing space "C" of the cylinder 122' through the hole 141*a* of the suction gasket 141.

In addition, on the contrary, when the piston 129 moves in the direction indicated by the arrow "D", the refrigerant gas is compressed in the compressing space "C" as shown in FIG. 3, and pushes the refrigerant gas suction opening/closing portion 142*a* of the suction valve 142 in the left-side direction of FIG. 4 in order for the refrigerant gas suction hole 143*a* of the valve sheet 143 to be closed.

Therefore, the refrigerant gas pushes the refrigerant gas discharging opening/closing portion 144*b* of the discharging valve 144 through the refrigerant gas discharging holes 142*b* and 143*b* of the suction valve 142 and the valve sheet 143. Thereafter, the refrigerant gas passes through the discharging gasket 145 and is then discharged to the outside of the hermetic housing 121 through the refrigerant gas discharging portion 146*a* of the head cover 146.

Meanwhile, the oil displacing mass 131 linearly reciprocates by the lineal reciprocating movement of the piston 129, and the inner volume of the oil pocket 132 is alternately varied, and the oil "O" filled at the bottom portion of the hermetic housing 121 is introduced into the friction portion between the cylinder 122' and the piston 129.

In more detail, when the oil displacing mass 131 is moved in the direction indicated by the arrow "X" of FIG. 3, since the pressure in the oil pocket 132 is made lower, the oil "O" filled at the bottom portion of the hermetic housing 121 is sucked up along the oil suction tube 147 connected to the head cover 146 of the valve assembly 139', and is then introduced through the oil suction portion 146*b* of the head cover 146, and the oil suction holes 145*b*, 144*c*, and 143*c* of the discharging gasket 145, the discharging valve 144, and the valve sheet 143. The thusly introduced oil pushes the oil suction opening/closing portion of the suction valve 142 and passes through the oil suction hole 141*b* of the suction gasket 141.

At this time, the pressure generated due to the movement of the piston 129 is applied to the oil discharging opening/closing portion 144*d* of the discharging valve 144, so that the oil discharging opening/closing portion 144*d* closes the oil discharging hole 143*d* of a valve sheets 143. As a result, when the oil "O" is sucked, the oil "O" is not temporally discharged.

The oil "O" passed through the oil suction hole 141*b* of the suction gasket 141 is supplied to the oil pocket 132 through the oil passing-through hole 122'*a* of the cylinder 122' and then fills the interior of the oil pocket 132. At this time, a part of the oil "O" is supplied to the friction portion between the cylinder 122' and the piston 129 through the oil introducing hole 122*a*.

In addition, on the contrary, when the oil displacing mass 131 moves to the Y-direction as shown in the accompanying drawing, since the volume of the oil pocket 132 is reduced, a part of the oil "O" filled in the oil pocket 132 passes through the oil discharging holes 141*c*, 142*d*, and 143*d* of the suction gasket 141, the suction valve 142, and the valve sheet 143 through the oil passing-through hole 122'*b* of the cylinder 122', and then the oil "O" pushes the oil discharging opening/closing portion 144*d* of the discharging valve 144 and then is discharged to the outside of the hermetic housing 121 through the oil discharging hole 145*c* of the discharging casket 145, the oil discharging portion 146*c* of the head cover 146, and the oil discharging tube 148.

At this time, the pressure generated by the movement of the piston 129 is applied to the oil suction opening/closing portion 142*c* of the suction valve 142 in order for the oil discharging opening/closing portion 142*c* to close the oil suction hole 143*c* of the valve sheet 143, so that the oil "O" is not temporarily sucked when the oil "O" is discharged.

The oil "O" is substantially transferred to the friction portion between the cylinder 122' and the piston 129 through the oil path of the valve assembly 139' in cooperation with the lineal reciprocating movement of the oil discharging mass 131 due to the lineal reciprocating movement of the piston 129, thus smoothly enabling the reciprocating movement of the piston 129.

An oil supply apparatus for a friction portion of a linear compressor according to the second embodiment of the present invention will now be described with reference to the accompanying drawings.

Figure 1:
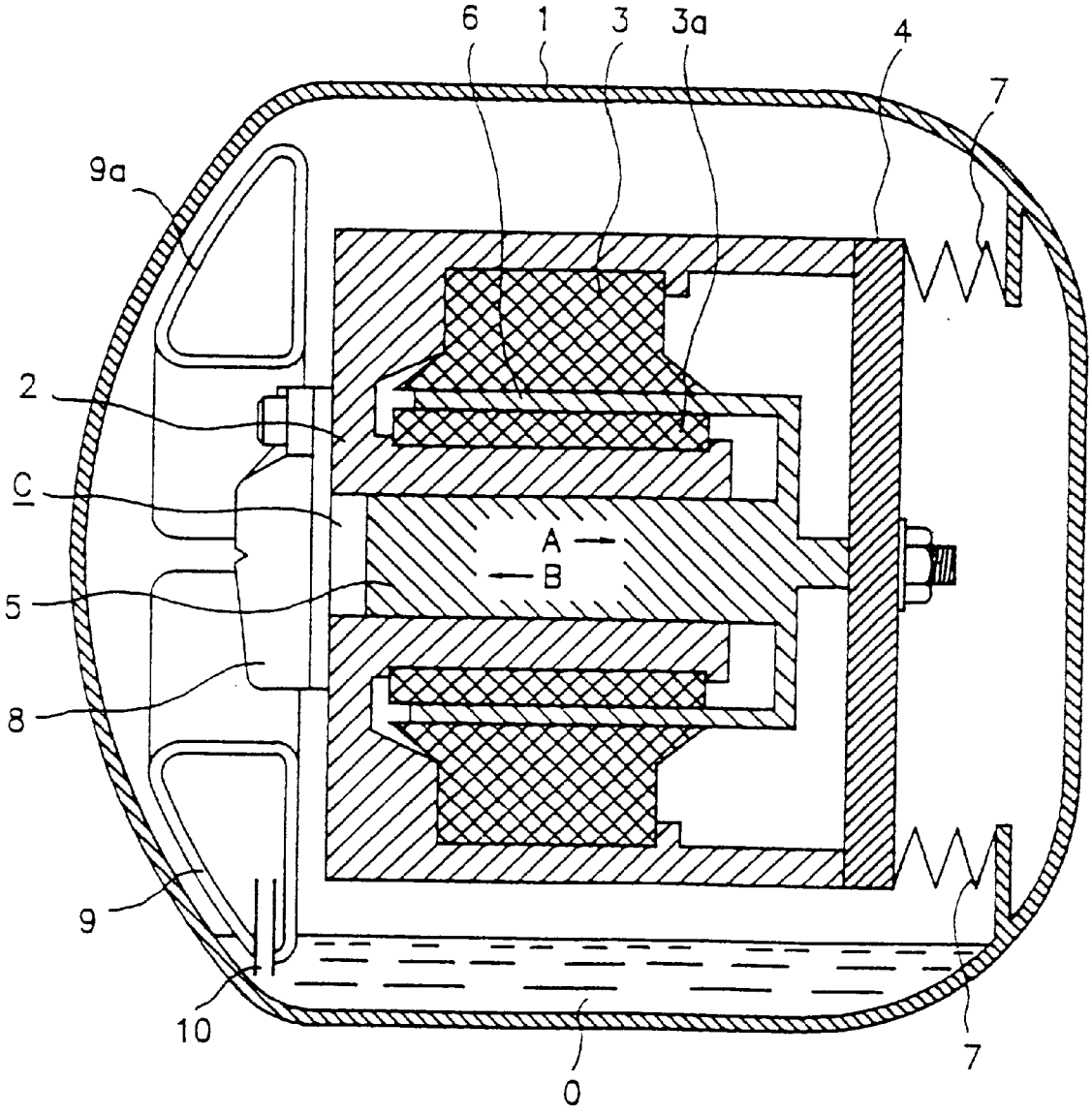
FIG. 1 PRIOR ART
FIG. 1 is a cross-sectional view of a conventional linear compressor.
Figure 2:
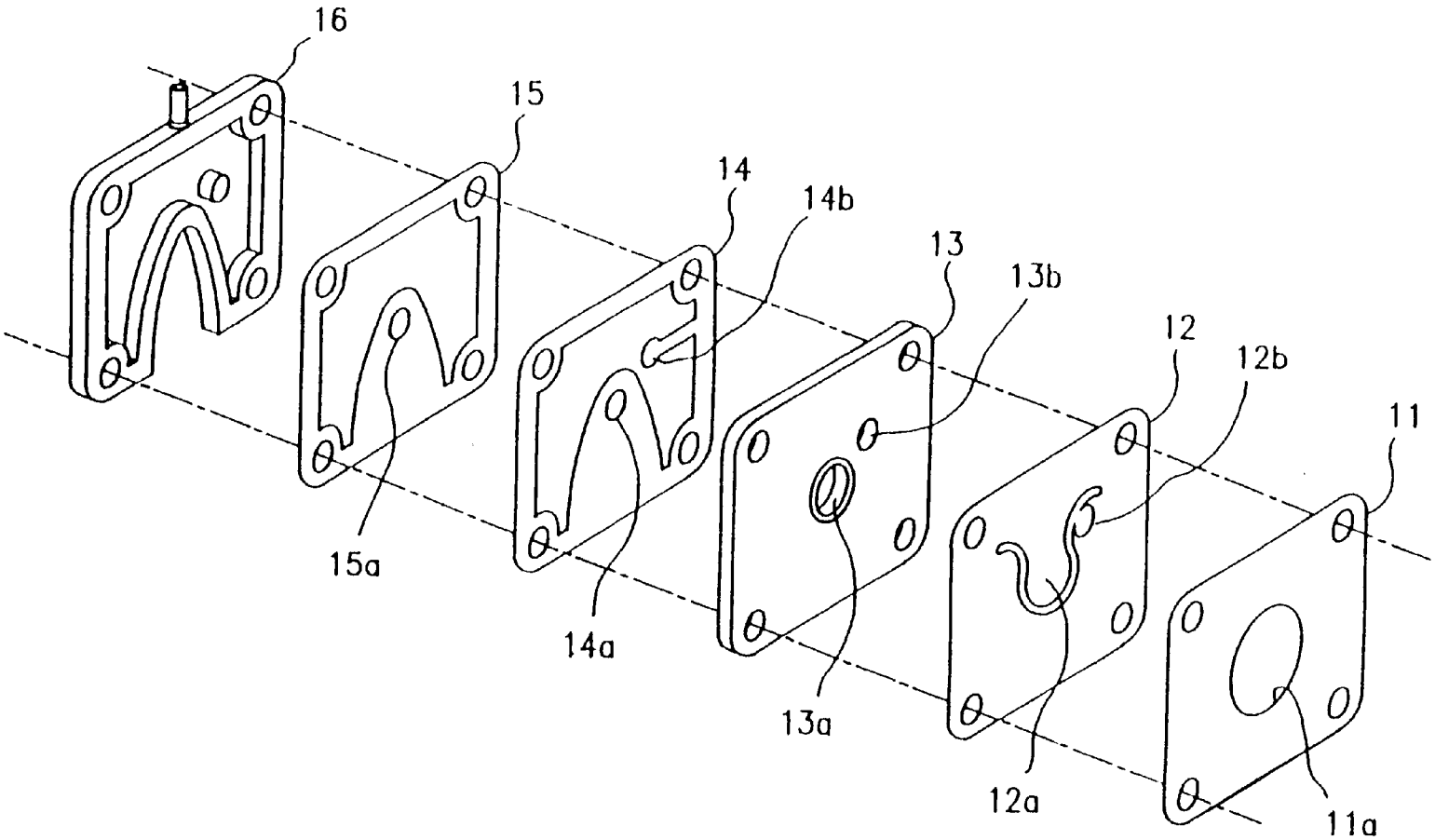
FIG. 2 PRIOR ART
FIG. 2 is a disassembled perspective view of a valve assembly used in a conventional linear compressor.
Figure 5:
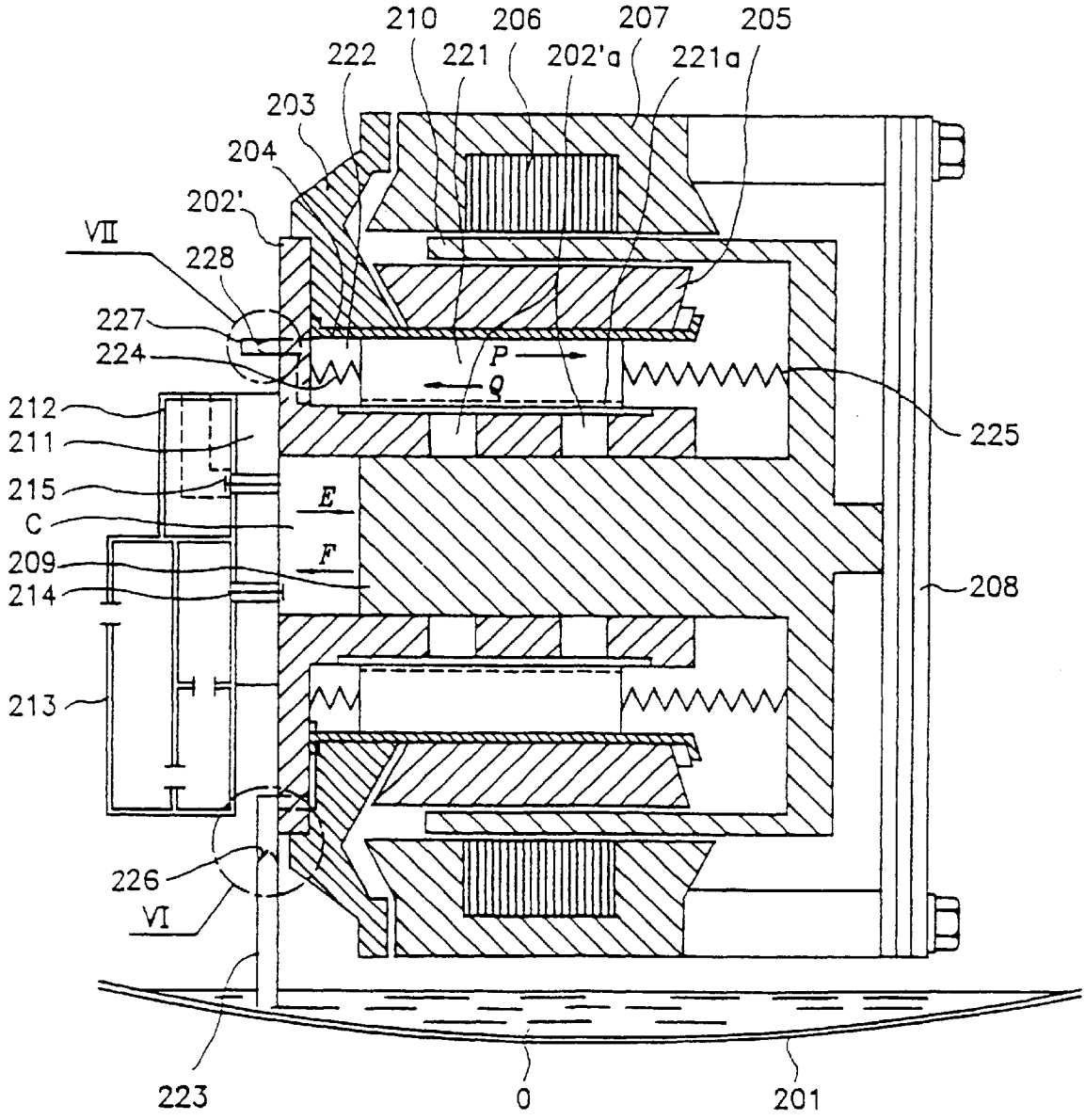
FIG. 5 is a cross-sectional view of an oil supply apparatus for a friction portion of a linear compressor according to a second embodiment of the present invention.
Figure 6:
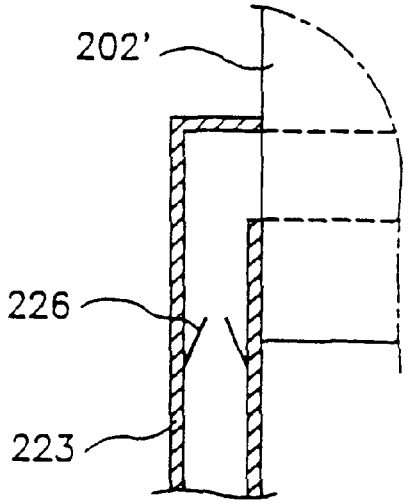
FIG. 6 is an enlarged cross-sectional view taken along line VI—VI of FIG. 5 according to the present invention.
Figure 7:
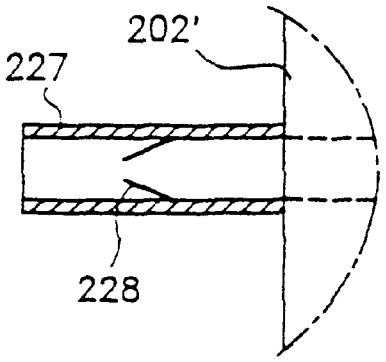
FIG. 7 is an enlarged cross-sectional view taken along line VII—VII of FIG. 5 according to the present invention.

As shown in FIGS. 5 through 7, the second embodiment of the present invention is very similar to that of the first embodiment. Namely, this embodiment does not include the construction of the valve assembly of FIG. 4. Instead of that, this embodiment includes a valve assembly provided with the refrigerant gas path as shown in FIG. 2, an oil suction tube 223 and an oil discharging tube 227 connected to an oil pocket 222 and provided with liquid diodes 226 and 228 which serve as a valve to suck and discharge the oil "O" filled at the bottom portion of the hermetic housing 201.

Therefore, the second embodiment of the present invention is directed to cooling a head cover 212 by using the oil "O" introduced into the oil discharging tube 227 connected to a predetermined portion of the cylinder 202' at the periphery of the head cover 212 and the valve sheet 211. Here, the oil "O" is transferred to the valve sheet 211 and servers as a sealant of the suction and discharging refrigerant gas.

The operation and effects of the oil supply apparatus for a friction portion of a linear compressor according to the second embodiment of the present invention will now be explained with reference to the accompanying drawings.

As shown in FIG. 5, a power is supplied to the linear compressor equipped with the oil supply apparatus for a friction portion of a linear compressor, a piston 209 reciprocates by the inter-relational operation between the current flowing at the stator coil 206 and the magnetic field of a magnet 210 attached to the piston 209 and an inertia energy and elastic energy of the piston spring 208.

At this time, when the piston moves in the direction indicated by the arrow "E" of FIG. 5 so as to suck the refrigerant gas, the pressure of the compressing space "C" is made lower, and the suction valve 214 of the valve sheet 211 is opened. At the same time, the discharging valve 215 is closed, and the refrigerant gas is sucked into the compressing space "C" through the suction valve 214.

Meanwhile, on the contrary, when the piston 209 moves in the direction indicated by the arrow "F" of FIG. 5, the suction valve 214 is closed, and at the same time, the discharging valve is opened. Therefore, the supply of the refrigerant gas is stopped, and at the same time, the refrigerant gas compressed in the compressing space "C" is discharged to the outside through the discharging valve 215 of the valve sheet 211.

Namely, the suction, compressing and discharging operation of the refrigerant gas is repeatedly performed due to the repeated lineal reciprocating movement of the piston 209.

Meanwhile, during the repeated lineal movement of the piston 209, since the elastic members 224 and 225 are connected between the cylinder 202' and the oil displacing mass 221, and the oil displacing mass 221 and the piston 209, the oil mass 221 also linearly reciprocates by the lineal reciprocating movement of the piston 209. Therefore, the volume of the oil pocket 222 is varied.

In more detail, when the oil displacing mass 221 moves in the direction indicated as the arrow "P", since the pressure of the oil pocket 222 is made lower, the oil "O" filled at the bottom portion of the hermetic housing 201 is sucked up through the oil suction tube 223 into the oil pocket 222, and then the oil"O" is filled in the oil pocket 222. Thereafter, a part of the oil "O" is supplied to the cylinder 202' through the oil introducing hole 202'*a*.

At this time, the oil "O" is substantially supplied to the friction portion between the cylinder 202' and the piston 209 in cooperation with the repeated lineal reciprocating movement of the piston 209, so that it is possible to achieve a more smooth reciprocating movement of the piston 209 in the cylinder 202'.

Since there is formed an oil path 221 a communicating with the oil introducing hole 202'*a* of the cylinder 202' at predetermined portions of the oil displacing mass 221 and the cylinder 202', a little of movement of the oil displacing mass 221 can cause the oil "o" sucked into the oil pocket 222 to be transferred to the friction portion between the cylinder 202' and the piston 209.

In addition, since the liquid diode 226 is disposed inside the oil suction tube 223, when the oil displacing mass 221 is even moved in the direction indicated by the arrow "Q" of FIG. 5, the oil "O" sucked into the oil pocket 222 is not reversely transferred to the bottom portion of the hermetic housing 201.

Meanwhile, when the oil mass 221 moves in the direction indicated by the arrow "Q", since the pressure of the oil pocket 222 is made higher, a part of the oil "O" filled in the oil pocket 222 is discharged through the oil discharging tube 227. Here, since the end portion of the oil discharging tube 227 is toward the head cover 212 and the valve sheet 211, the head cover 212 is effectively cooled by the discharging oil "O". In addition, the oil "O" discharged can be used as a sealant of the suction and discharging refrigerant gas.

Here, since the liquid diode 228 is disposed inside the oil discharging tube 227, the oil "O" discharged to the outside is not reversely flown.

Meanwhile, the oil suction tube 223 of the present invention may be connected to the cylinder 202' in order for the oil "O" to be transferred to the oil pocket 222 through the cylinder 202'. In addition, the oil suction tube 223 may be connected to the flange 203 in order for the oil "o" to be supplied to the oil pocket 222 through the flange 203. The oil suction tube 223 may be connected to the cylinder 202' in order for the oil "O" to be supplied to the oil pocket 222 through the cylinder 202' and the flange 203.

Figure 8:
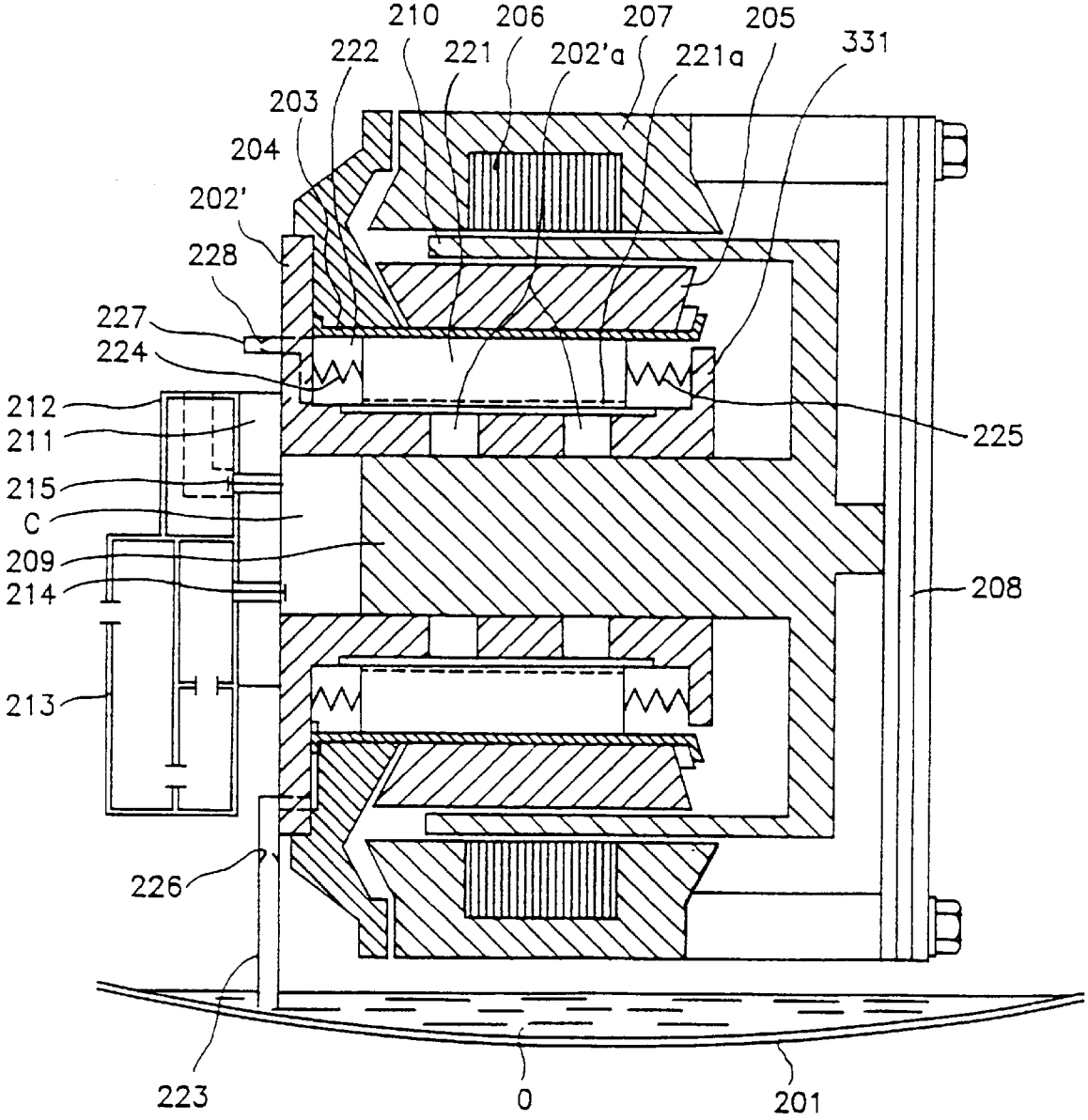
FIG. 8 is a cross-sectional view of an oil supply apparatus for a friction portion of a linear compressor according to a third embodiment of the present invention.

FIG. 8 shows the oil supply apparatus for a friction portion of a linear compressor according to a third embodiment of the present invention.

As shown therein, the construction is similar to that of the second embodiment of the present invention. Namely, a support wall 331 is disposed at the outer circumferential surface of the cylinder 202'. In addition, as an elastic means, elastic members 224 and 225 are disposed between the cylinder 202' and the oil displacing mass 221, and the oil displacing mass 221 and the support wall 331.

Therefore, the oil supply apparatus for a friction portion of a linear compressor is basically directed to disposing the elastic members 224 and 225 between the cylinder 202' and the oil displacing mass 221, and the oil displacing mass 221 and the support wall 331 in order for the oil displacing mass 221 to linearly reciprocate by the vibration itself of the linear compressor.

Namely, in this embodiment, the oil "O" of the hermetic housing 201 can be supplied to the friction portion between the cylinder 202' and the piston 209 in cooperation with the reciprocating movement of the oil displacing mass 221 as in the second embodiment of the present invention.

As described above, the oil supply apparatus for a friction portion of a linear compressor according to the present invention is directed to substantially supplying oil to the friction portion between the cylinder and the piston, thus enhancing the lubricant performance of the piston and the efficiency of the system.

In addition, it is possible to effectively cool the heated portion of the system due to the refrigerant gas by flowing the oil to the heated portion. The construction of the present invention is made simpler by fabricating the flowing path of the refrigerant gas and the flowing path of the oil to be one structure compared to the conventional art, thus reducing the manufacturing cost and improving the productivity.

Moreover, the present invention is directed to mounting the liquid diodes serving as the valve at the interior of the oil suction tube, thus preventing the oil from reversely flowing.

Although the preferred embodiments of the present invention have been disclosed for illustrative purposes, those skilled in the art will appreciate that various modifications, additions and substitutions are possible, without departing from the scope and spirit of the invention as described in the accompanying claims.

We claim:

1. An oil supply apparatus for a friction portion of a linear compressor, comprising:

a cylinder having a plurality of oil introducing holes for communicating the inside and the outside of the cylinder;

a piston disposed within said cylinder and reciprocating therewithin;

an oil displacing mass for oil suction disposed between the cylinder and a core liner spaced apart from the cylinder and slidable within an oil pocket communicating with the cylinder by an oil suction hole;

elastic means disposed between the cylinder and the oil displacing mass for elastically supporting the oil displacing mass; and a valve assembly for a refrigerant gas flowing path for guiding the flowing of the refrigerant gas including a suction gasket integral with an oil flowing path for guiding the flowing of the oil supplied to an discharged from the friction portion between the cylinder and the piston, a suction valve, a valve sheet, a discharging valve, a discharging gasket, and a head cover.

2. The apparatus of claim 1, wherein said refrigerant gas flowing path is formed to communicate in order a refrigerant gas suction hole of the discharging gasket, a refrigerant gas suction hole of the discharging valve, a refrigerant gas suction hole of the valve sheet, a refrigerant gas suction opening/closing portion of the suction valve, a hole of the suction gasket, a refrigerant gas discharging hole of the suction valve, a refrigerant gas discharging hole of the valve sheet, a discharging opening/closing portion of the discharging valve, and a refrigerant discharging portion of the head cover.

3. The apparatus of claim 1, wherein said oil flowing path is formed to communicate in order an oil suction portion of the head cover, an oil suction hole of the discharging gasket, an oil suction hole of the discharging valve, an oil suction hole of the valve sheet, an oil suction opening/closing portion of the suction valve, an oil suction hole and an oil discharging hole of the suction gasket, an oil discharging hole of the suction valve, an oil discharging hole of the valve sheet, an oil discharging opening/closing portion of the discharging valve, an oil discharging hole of the discharging gasket, and an oil discharging portion of the head cover.

4. The apparatus of claim 1, wherein said elastic means is referred to an elastic member disposed between the cylinder and the oil mass.

5. The apparatus of claim 1, wherein said elastic means is either an elastic member disposed between the cylinder and the oil displacing mass or an elastic member disposed between the oil displacing mass and the piston.

6. The apparatus of claim 5, wherein said elastic member disposed between the oil displacing mass and the piston is a flexible rod.

7. The apparatus of claim 1, wherein said oil displacing mass is cylindrical and is attached to the outer circumferential surface of the cylinder.

8. The apparatus of claim 1, wherein an oil supply path is formed at an outer surface of the oil displacing mass in order for the oil introduced into the oil pocket to be introduced into the cylinder.

9. The apparatus of claim 1, wherein an oil supply path is formed at an outer surface of the cylinder in order for the oil introduced into the oil pocket to be introduced into the cylinder.

10. An oil supply apparatus for a friction portion of a linear compressor, comprising:

a cylinder having a plurality of oil introducing holes for communicating the inside and the outside of the cylinder;

a piston disposed within said cylinder and reciprocating therewithin;

an oil displacing mass for oil suction disposed between the cylinder and a core liner spaced apart from the cylinder and slidable within an oil pocket communicating with the cylinder by an oil suction hole;

elastic means disposed between the cylinder and the oil displacing mass for elastically supporting the oil displacing mass; and an oil suction tube communicating with the oil pocket so as to suck oil collected at a bottom portion of a hermetic housing.

11. The apparatus of claim 10, wherein said elastic means is referred to an elastic member disposed between the cylinder and the oil mass.

12. The apparatus of claim 10, wherein said elastic means is either an elastic member disposed between the cylinder and the oil displacing mass or an elastic member disposed between the oil displacing mass and the piston.

13. The apparatus of claim 12, wherein said elastic member disposed between the oil displacing mass and the piston is referred to a flexible rod.

14. The apparatus of claim 10, wherein said elastic means is referred to an elastic member disposed between the cylinder and the oil displacing mass, and the oil displacing mass and support wall disposed at the outer portion of the cylinder.

15. The apparatus of claim 10, wherein said oil displacing mass is cylindrical and is attached to the outer circumferential surface of the cylinder.

16. The apparatus of claim 10, wherein an oil supply path is formed at an outer surface of the oil displacing mass in order for the oil introduced into the oil pocket to be introduced into the cylinder.

17. The apparatus of claim 10, wherein an oil supply path is formed at an outer surface of the cylinder in order for the oil introduced into the oil pocket to be introduced into the cylinder.

18. The apparatus of claim 10, wherein said oil suction tube communicates with the interior of the cylinder.

19. The apparatus of claim 10, wherein a liquid diode is disposed at the oil suction tube so as to prevent a reverse flowing of the oil.

20. The apparatus of claim 10, wherein an oil discharging tube is connected to the cylinder in order for the oil to be discharged to a head cover and a valve sheet.

21. The apparatus of claim 20, wherein a liquid diode is disposed at the oil discharging tube so as to prevent a reverse flowing of the oil.

* * * * *